US011351603B2

(12) United States Patent
Shimamoto et al.

(10) Patent No.: US 11,351,603 B2
(45) Date of Patent: Jun. 7, 2022

(54) MIXED POWDER FOR POWDER METALLURGY AND LUBRICANT FOR POWDER METALLURGY

(71) Applicant: JFE STEEL CORPORATION, Tokyo (JP)

(72) Inventors: Hanako Shimamoto, Tokyo (JP); Shigeru Unami, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 17/271,204

(22) PCT Filed: Sep. 20, 2019

(86) PCT No.: PCT/JP2019/037062
§ 371 (c)(1),
(2) Date: Feb. 25, 2021

(87) PCT Pub. No.: WO2020/066927
PCT Pub. Date: Apr. 2, 2020

(65) Prior Publication Data

US 2021/0394264 A1 Dec. 23, 2021

(30) Foreign Application Priority Data

Sep. 26, 2018 (JP) ..... JP2018-180333

(51) Int. Cl.

| | |
|---|---|
| ***C10M 105/38*** | (2006.01) |
| ***B22F 1/00*** | (2022.01) |
| ***B22F 1/10*** | (2022.01) |
| ***B22F 1/05*** | (2022.01) |
| ***B22F 3/02*** | (2006.01) |
| ***C10M 129/74*** | (2006.01) |
| ***C10M 169/04*** | (2006.01) |
| *C10N 40/20* | (2006.01) |

(52) U.S. Cl.
CPC ..... *B22F 1/10* (2022.01); *B22F 1/05* (2022.01); *B22F 3/02* (2013.01); *C10M 105/38* (2013.01); *C10M 129/74* (2013.01); *C10M 169/04* (2013.01); *B22F 2301/35* (2013.01); *C10M 2207/345* (2013.01); *C10N 2040/243* (2020.05); *C10N 2040/246* (2020.05)

(58) Field of Classification Search
CPC . B22F 1/0059; B22F 2301/35; C10M 105/38; C10M 129/74; C10M 169/04; C10M 2207/345; C10N 2040/243; C10N 2040/246
See application file for complete search history.

(56) References Cited

U.S. PATENT DOCUMENTS

| | | | | |
|---|---|---|---|---|
| 5,480,469 | A | 1/1996 | Storstrom et al. | |
| 5,518,639 | A | 5/1996 | Luk et al. | |
| 6,436,166 | B2 | 8/2002 | Arvidsson et al. | |
| 6,447,571 | B1 | 9/2002 | Ito et al. | |
| 7,390,345 | B2 | 6/2008 | Solimnjad | |
| 7,789,934 | B2 | 9/2010 | Suzuki et al. | |
| 2002/0189405 | A1* | 12/2002 | Liu | B22F 7/00 75/767 |
| 2003/0230166 | A1* | 12/2003 | Ramstedt | C10M 169/04 75/252 |
| 2006/0165549 | A1* | 7/2006 | Azzi | B22F 1/0059 419/65 |
| 2011/0062630 | A1* | 3/2011 | Honda | A61K 9/2054 264/299 |
| 2012/0031233 | A1* | 2/2012 | Lindenau | C10M 105/38 75/252 |
| 2015/0314372 | A1 | 11/2015 | Ono et al. | |
| 2015/0361255 | A1* | 12/2015 | Ito | B22F 1/00 75/230 |
| 2017/0304893 | A1* | 10/2017 | Ito | C10M 105/70 |
| 2018/0182520 | A1* | 6/2018 | Mitani | B22F 1/0059 |
| 2019/0283126 | A1* | 9/2019 | Akagi | B22F 1/00 |
| 2019/0344340 | A1* | 11/2019 | Kim | B22F 1/0062 |

FOREIGN PATENT DOCUMENTS

| | | | |
|---|---|---|---|
| EP | 1025937 | A1 | 8/2000 |
| EP | 2366475 | A1 | 9/2011 |
| JP | S4938083 | B1 | 10/1974 |
| JP | H06506726 | A | 7/1994 |
| JP | 2003508635 | A | 3/2003 |
| JP | 2009007641 | A | 1/2009 |
| JP | 2010280990 | A | 12/2010 |
| JP | 2013043790 | A | 3/2013 |
| WO | 9605275 | A1 | 2/1996 |
| WO | 0003823 | A1 | 1/2000 |
| WO | 2005068588 | A1 | 7/2005 |

OTHER PUBLICATIONS

Oct. 11, 2021, the Extended European Search Report issued by the European Patent Office in the corresponding European Patent Application No. 19864182.1.
Oct. 15, 2019, International Search Report issued in the International Patent Application No. PCT/JP2019/037062.

* cited by examiner

*Primary Examiner* — Ellen M McAvoy
(74) *Attorney, Agent, or Firm* — Kenja IP Law PC

(57) ABSTRACT

Provided is a mixed powder for powder metallurgy that contains a readily available compound as a lubricant, does not need to contain a stain-causing metal soap, has excellent ejection properties and compressibility, and can exhibit excellent fluidity without deteriorating the ejection properties or the compressibility even in the case of further containing carbon black. The mixed powder for powder metallurgy comprising an (a) iron-based powder and a (b) lubricant, wherein the (b) lubricant is an ester of disaccharide and fatty acid represented by R—COOH, and the R is an alkyl group having 11 or more carbon atoms or an alkenyl group having 11 or more carbon atoms.

19 Claims, No Drawings

MIXED POWDER FOR POWDER METALLURGY AND LUBRICANT FOR POWDER METALLURGY

TECHNICAL FIELD

This disclosure relates to a mixed powder for powder metallurgy, and particularly to a mixed powder for powder metallurgy that does not need to use a stain-causing metal soap and has excellent ejection properties and compressibility. In addition, this disclosure relates to a mixed powder for powder metallurgy that can achieve excellent fluidity, ejection properties and compressibility in the case of further adding carbon black. Further, this disclosure relates to a lubricant for powder metallurgy.

BACKGROUND

Powder metallurgy technology is a method with which parts having complex shapes can be compacted in a shape that is extremely close to the shape of the product and can be produced with high dimensional accuracy. Further, the powder metallurgy technique can significantly reduce cutting costs. Therefore, powder metallurgical products are widely used as all kinds of machines and parts.

In powder metallurgy, a mixed powder (hereinafter referred to as "mixed powder for powder metallurgy" or simply "mixed powder") is used, where the mixed powder is obtained by mixing an iron-based powder, which is a main raw material, with, if necessary, an alloying powder such as copper powder, graphite powder and iron phosphide powder, a powder for improving machinability such as MnS, and a lubricant.

The lubricant contained in the mixed powder for powder metallurgy plays an extremely important role when such a mixed powder for powder metallurgy is subjected to compaction to produce a product. The effects of the lubricant will be described below.

First, the lubricant has a lubrication effect when the mixed powder is subjected to compaction in a die. The lubrication effect is further roughly divided into the following two. One is the effect of reducing the friction between particles contained in the mixed powder. During the compaction, the lubricant enters between the particles to reduce the friction, thereby promoting the rearrangement of the particles. The other is the effect of reducing the friction between the die used for compaction and the particles. The lubricant on the surface of the die enters between the die and the particles, thereby reducing the friction between the die and the particles. With these two effects, the mixed powder can be compressed to a high density during the compaction.

In addition, the lubricant also has a lubrication effect when a green compact, which is formed by subjecting the mixed powder to compaction in the die, is taken (ejected) out of the die. Generally, a green compact is ejected out of a die by pushing it out with a punch, where large frictional resistance is generated due to the friction between the green compact and the surface of the die. In this case, some of the lubricant contained in the mixed powder on the surface of the die reduces the frictional force.

As described above, the lubricant contained in the mixed powder for powder metallurgy plays a very important role during the compaction. However, the lubricant is only required during the compaction and the ejection out of the die and is unnecessary after the ejection. Further, it is desirable that the lubricant disappears during the sintering of the green compact, so that no lubricant remains in a final sintered body.

In addition, since the lubricant generally has a stronger adhesive power than the iron-based powder, it deteriorates the fluidity of the mixed powder. Further, since the lubricant has a smaller specific gravity than the iron-based powder, the density of the green compact is lowered when a large amount of lubricant is added.

Furthermore, the lubricant used in the mixed powder for powder metallurgy is required to function as a binder in some cases. The binder here refers to a component that allows an alloying powder and other additive components to adhere to the surface of the iron-based powder which is a main component. A common mixed powder for powder metallurgy is obtained by simply mixing an iron-based powder with additive components such as an alloying powder, a powder for improving machinability, and a lubricant. However, each component may segregate inside the mixed powder in this state. Particularly for graphite powder, which is generally used as an alloying powder, it tends to segregate when the mixed powder is flowed or vibrated because it has a smaller specific gravity than other components. In order to prevent such segregation, it has been proposed that the additive components be adhered to the surface of the iron-based powder via a binder. Such a mixed powder for powder metallurgy in which additive components are adhered to the surface of the iron-based powder via a binder is also referred to as a segregation prevention treatment powder. The segregation prevention treatment powder has the additive components adhered to the iron-based powder, thereby preventing the above-described segregation of additive components.

The binder used in such a segregation prevention treatment powder usually is a compound that also functions as a lubricant. This is because, by using a binder also having lubricating ability, the total amount of the binder and the lubricant added to the mixed powder can be reduced.

Generally, such a mixed powder for powder metallurgy is subjected to press forming at a pressure of 300 MPa to 1000 MPa to obtain a green compact having a predetermined part shape, and then the green compact is sintered at a high temperature of 1000° C. or higher to obtain a final product (such as a machine part). In this case, the total amount of the lubricant and the binder contained in the mixed powder is generally about 0.1 parts by mass to 2 parts by mass with respect to 100 parts by mass of the iron-based powder. In order to increase the green density, i.e., the density of the green compact, the amount of the lubricant and the binder added is preferably small. Therefore, the lubricant is required to exhibit excellent lubricating ability while being added at a small amount.

Conventionally, metal soaps such as zinc stearate are widely used as the lubricant. However, metal soaps cause stains on surfaces of furnaces, workpieces, sintered bodies, etc. during the process of sintering a green compact. For this reason, various lubricants have been proposed to replace the metal soap.

For example, JP H06-506726 A (PTL 1) proposes using diamide wax as a lubricant. In the technique proposed in PTL 1, the diamide wax also serves as a binder. In addition, WO 2005/068588 A1 (PTL 2) proposes using polyhydroxycarboxylic acid amide as a lubricant.

Further, in order to improve the fluidity of the mixed powder for powder metallurgy containing a lubricant, it is proposed further adding a powder for improving fluidity to the mixed powder for powder metallurgy.

For example, JP 2003-508635 A (PTL 3) proposes adding a fluidity improver such as silica to a mixed powder containing a lubricant such as diamide wax to improve the fluidity. In addition, JP 2010-280990 A (PTL 4) proposes adding carbon black to a mixed powder containing a lubricant such as diamide wax to improve the fluidity and the apparent density.

CITATION LIST

Patent Literature

PTL 1: JP H06-506726 A
PTL 2: WO 2005/068588 A1
PTL 3: JP 2003-508635 A
PTL 4: JP 2010-280990 A

SUMMARY

Technical Problem

However, the polyhydroxycarboxylic acid amide proposed in PTL 2 must be synthesized by an amidation reaction using polyhydroxycarboxylic acid or its equivalent and an aliphatic amine as raw materials, which is not readily available.

In addition, the diamide wax used as a lubricant in PTL 1 and other documents does not have sufficient ejection properties.

Further, when particles such as silica or carbon black are added to a conventional lubricant to improve the fluidity, as proposed in PTL 3 and PTL 4, the compressibility of the mixed powder is deteriorated. When the compressibility deteriorates, spring back increases during the compaction. As a result, the ejection properties deteriorate.

It could thus be helpful to provide a mixed powder for powder metallurgy that contains a readily available compound as a lubricant, does not need to contain a stain-causing metal soap, has excellent ejection properties and compressibility, and can exhibit excellent fluidity without deteriorating the ejection properties or the compressibility even in the case of further containing carbon black.

Solution to Problem

As a result of intensive study, we found that the problem can be solved when an ester of disaccharide and fatty acid, which is readily available as a commercial product, is used as a lubricant. The present disclosure is based on the findings, and the primary features thereof are as follows.

1. A mixed powder for powder metallurgy comprising an (a) iron-based powder and a (b) lubricant, wherein the (b) lubricant is an ester of disaccharide and fatty acid represented by R—COOH, and the R is an alkyl group having 11 or more carbon atoms or an alkenyl group having 11 or more carbon atoms.

2. The mixed powder for powder metallurgy according to 1., wherein the R is an alkyl group having 11 to 21 carbon atoms or an alkenyl group having 11 to 21 carbon atoms.

3. The mixed powder for powder metallurgy according to 1. or 2., wherein the lubricant has a melting point of 40° C. or higher.

4. The mixed powder for powder metallurgy according to any one of 1. to 3., further comprising one or both of an (c) alloying powder and a (d) machinability improver.

5. The mixed powder for powder metallurgy according to 4., wherein one or both of the (c) alloying powder and the (d) machinability improver are adhered to a surface of the (a) iron-based powder via a (e) binder.

6. The mixed powder for powder metallurgy according to 5., wherein the binder (e) is the ester of disaccharide and fatty acid.

7. The mixed powder for powder metallurgy according to 5. or 6., further comprising (f) carbon black in an amount of 0.01 parts by mass to 0.3 parts by mass with respect to 100 parts by mass of the (a) iron-based powder.

8. A lubricant for powder metallurgy, which is an ester of disaccharide and fatty acid represented by R—COOH, wherein the R is an alkyl group having 11 or more carbon atoms or an alkenyl group having 11 or more carbon atoms.

Advantageous Effect

The mixed powder for powder metallurgy of the present disclosure can exhibit extremely excellent ejection properties and compressibility without containing any stain-causing metal soap. In addition, the mixed powder for powder metallurgy can exhibit excellent fluidity without deteriorating the ejection properties or the compressibility even in the case where hard fine particles such as carbon black are added to improve the fluidity. Further, the ester of disaccharide and fatty acid used as a lubricant in the present disclosure is readily available as a commercial product, which is also advantageous in terms of production and costs.

DETAILED DESCRIPTION

The following describes embodiments of the present disclosure in detail. Note that the following description is exemplification of preferred embodiments of the present disclosure and does not limit the scope of the present disclosure.

The mixed powder for powder metallurgy of an embodiment of the present disclosure contains the following (a) and (b) as essential components. The mixed powder for powder metallurgy of other embodiments of the present disclosure can further optionally contain at least one selected from the following (c) to (f), in addition to the (a) and (b). Each component will be described below.

(a) Iron-based powder
(b) Lubricant
(c) Alloying powder
(d) Machinability improver
(e) Binder
(f) Carbon black (a) Iron-Based Powder The iron-based powder is not particularly limited and may be any iron-based powder. The iron-based powder is preferably at least one of an iron powder and an alloyed steel powder. As used herein, the "iron-based powder" refers to a metal powder containing 50 mass % or more of Fe. Additionally, the "iron powder" refers to a powder consisting of Fe and inevitable impurities and is generally referred to as "pure iron powder" in this technical field.

The alloyed steel powder is preferably an alloy powder containing at least one alloying element, where the balance consists of Fe and inevitable impurities, and the Fe content is 50 mass % or more. The alloying element may be, for example, at least one selected from the group consisting of C, Cu, Ni, Mo, Mn, Cr, V, and Si. The alloyed steel powder may be, for example, at least one selected from the group consisting of a pre-alloyed steel powder (fully alloyed steel powder) where an alloying element is pre-alloyed during smelting, a partially diffused alloyed steel powder where an alloying element is partially diffused in an iron powder and alloyed, and a hybrid alloyed steel powder where an alloying element is further partially diffused in a pre-alloyed steel powder. In other words, the pre-alloyed steel powder is an alloyed steel powder having a substantially uniform distribution of alloying elements; the partially diffused alloyed steel powder is a powder containing an iron powder as a core and particles of alloying elements diffuse-bonded to the surface of the iron powder; and the hybrid steel powder is a powder containing a pre-alloyed steel powder as a core and particles of alloying elements diffuse-bonded to the surface of the pre-alloyed steel powder.

The iron-based powder may be any iron-based powder, such as a reduced iron-based powder produced by reducing iron oxide, or an atomized iron-based powder produced with an atomizing method. Although the average particle size of the iron-based powder is not particularly limited, it is preferably 30 μm or more. When the average particle size is 30 μm or more, the powder fluidity is further improved. In addition, the average particle size is preferably 120 μm or less. When the average particle size is 120 μm or less, the green density is further improved, and the strength of the green compact is further improved.

The ratio of the mass of the iron-based powder to the total mass of the mixed powder for powder metallurgy is not particularly limited, yet it is preferably 85 mass % or more and more preferably 90 mass % or more.

(b) Lubricant

[Ester of Disaccharide and Fatty Acid]

In the present disclosure, it is important to use an ester of disaccharide and fatty acid represented by R—COOH as the lubricant, where R is an alkyl group having 11 or more carbon atoms or an alkenyl group having 11 or more carbon atoms. In other words, the fatty acid is a saturated fatty acid having 12 or more carbon atoms or a monounsaturated fatty acid having 12 or more carbon atoms.

By using the ester as a lubricant, excellent ejection properties and compressibility can be realized without containing any metal soap. In addition, in the case of using carbon black in combination as described later, a decrease in ejection properties due to carbon black can be suppressed. Further, the ester is also advantageous in that it is readily available as a commercial product. The ester may be used alone or in combination of two or more.

When the number of carbon atoms of the alkyl group and the alkenyl group is less than 11, the lubrication performance is insufficient. Therefore, the number of carbon atoms is set to 11 or more. On the other hand, the upper limit of the number of carbon atoms is not particularly limited, yet it is preferably 30 or less and more preferably 22 or less from the viewpoint of easy availability.

Further, the disaccharide is not particularly limited and may be any disaccharide, yet it is preferably sucrose from the viewpoint of easy availability. In other words, it is preferable to use a sucrose fatty acid ester as the lubricant.

Examples of the ester include the following compounds.

Sucrose lauric acid ester
Sucrose myristic acid ester
Sucrose palmitic acid ester
Sucrose stearic acid ester
Sucrose oleic acid ester
Sucrose behenic acid ester
Sucrose erucic acid ester The ester is preferably solid at 20° C. The lubricant is preferably solid at around room temperature of 20° C., because in this case, the fluidity of the mixed powder will not be impaired even if the mix proportion of the lubricant is increased. The ester is more preferably solid at 25° C. and even more preferably solid at 30° C.

The melting point of the ester is preferably 40° C. or higher. This is because, even when the lubricant powder is mixed with the iron-based powder at a temperature around room temperature, the temperature inside a mixer may be close to 40° C. due to frictional heat. Therefore, by using the ester having a melting point of 40° C. or higher as a lubricant, it is possible to prevent the formation of agglomerates during mixing.

The amount of the ester in the mixed powder for powder metallurgy is not particularly limited, yet it is preferably 0.1 parts by mass or more with respect to 100 parts by mass of the iron-based powder from the viewpoint of enhancing the effect of adding the ester. Further, from the viewpoint of further improving the green density, the amount of the ester is preferably 1.0 part by mass or less with respect to 100 parts by mass of the iron-based powder.

[Other Lubricants]

The mixed powder for powder metallurgy of the present disclosure may contain only the above-described ester as the lubricant and may further contain other lubricants. The other lubricant is not particularly limited and may be any lubricant. For example, the other lubricant is preferably at least one selected from an amide compound, a high molecular compound, and a metal soap. Examples of the amide compound include fatty acid monoamide, fatty acid bisamide, and amide oligomers. Examples of the high molecular compound include polyamide, polyethylene, polyester, polyol, and saccharides. Examples of the metal soap include zinc stearate and calcium stearate.

However, from the viewpoint of fully exhibiting the excellent properties of the ester, it is desirable that the ratio of the other lubricant is low. Specifically, the ratio of the mass of the ester to the total mass of the lubricant contained in the mixed powder for powder metallurgy is preferably 50 mass % or more, more preferably 65 mass % or more, and further preferably 80 mass % or more. The upper limit of the ratio of the mass of the ester to the total mass of the lubricant contained in the mixed powder for powder metallurgy is not particularly limited, yet it may be 100 mass %.

In one embodiment of the present disclosure, the mixed powder for powder metallurgy may further contain one or both of an (c) alloying powder and a (d) machinability improver.

(c) Alloying Powder

When a mixed powder containing an alloying powder is sintered, an alloying element contained in the alloying powder dissolves in iron and alloys. Therefore, using an alloying powder can improve the strength of a final sintered body. In other words, the alloying powder is a powder of an alloying element.

The alloying powder is not particularly limited and may be any powder that can be an alloying component. For example, the alloying powder may be at least one powder selected from the group consisting of C, Cu, Ni, Mo, Mn, Cr, V, and Si. When C is used as the alloying component, the alloying powder is preferably graphite powder.

(d) Machinability Improver

Adding a machinability improver can improve the machinability (workability) of a final sintered body. For example, the machinability improver may be at least one selected from the group consisting of MnS, $CaF_2$, and talc.

The amount of the (c) alloying powder and the (d) machinability improver added is not particularly limited and may be any amount. The total amount of the (c) alloying powder and the (d) machinability improver is preferably 10 parts by mass or less, more preferably 7 parts by mass or less, and further preferably 5 parts by mass or less with respect to 100 parts by mass of the iron-based powder. When the total amount of the (c) alloying powder and the (d) machinability improver is within the above ranges, the density of the sintered body can be further increased, and the strength of the sintered body can be further improved. On the other hand, since the (c) alloying powder and the (d) machinability improver do not necessarily have to be contained, the lower limit of the total amount with respect to 100 parts by mass of the iron-based powder may be 0 parts by mass. However, when the (c) alloying powder and the (d) machinability improver are contained, the total amount is preferably 0.1 parts by mass or more, more preferably 0.5 parts by mass or more, and further preferably 1 part by mass or more. When the total amount of the (c) alloying powder and the (d) machinability improver is within the above ranges, the effect of adding these components can be further enhanced.

(e) Binder

When the mixed powder for powder metallurgy contains at least one of the alloying powder and the machinability improver, it is preferable to further add a binder to prevent segregation. The binder allows one or both of the alloying powder and the machinability improver to adhere to the surface of the iron-based powder, thereby preventing segregation and further improving the properties of the sintered body. That is, the mixed powder for powder metallurgy can be used as a segregation prevention treatment powder. In other words, the mixed powder for powder metallurgy of an embodiment of the present disclosure contains the (a) iron-based powder, the (b) lubricant, one or both of the (c) alloying powder and the (d) machinability improver, and the (e) binder, where one or both of the alloying powder and the machinability improver adhere to the surface of the iron-based powder via the binder.

The binder may be anything that allows one or both of the alloying powder and the machinability improver to adhere to the surface of the iron-based powder. However, if the binder has lubricating ability, the total amount of the binder and the lubricant in the whole mixed powder can be reduced. Therefore, it is preferable to use a binder that functions as a lubricant. In that case, it can be considered that the binder also serves as a lubricant. In other words, the mixed powder for powder metallurgy of an embodiment of the present disclosure contains the (a) iron-based powder, the (b) lubricant, and one or both of the (c) alloying powder and the (d) machinability improver, where one or both of the alloying powder and the machinability improver adhere to the surface of the iron-based powder via the lubricant.

Examples of such a binder that can also serve as a lubricant are the same as those of the lubricant described above, including amide compounds such as fatty acid monoamide, fatty acid bisamide, and amide oligomers; and high molecular compounds such as polyamide, polyethylene, polyester, polyol, and saccharides. It is also preferable to use the ester of disaccharide and fatty acid represented by R—COOH described above as the binder. In that case, the ester can serve as both the (e) binder and the (b) lubricant.

(f) Carbon Black

In one embodiment of the present disclosure, carbon black may be added to the mixed powder as a fluidity improver to further improve the fluidity. In the case of using carbon black, the amount of the carbon black added is 0.01 parts by mass to 0.3 parts by mass with respect to 100 parts by mass of the iron-based powder. When the amount of carbon black added is less than 0.01 parts by mass, a sufficient fluidity improving effect cannot be obtained. On the other hand, when the amount of carbon black added exceeds 0.3 parts by mass, the compressibility and the ejection properties deteriorate. The amount of carbon black added is preferably 0.05 parts by mass or more. Further, the amount of carbon black added is preferably 0.2 parts by mass or less and more preferably 0.1 parts by mass or less.

[Production Method]

The mixed powder of the present disclosure is not particularly limited and may be produced with any method. However, in one embodiment, the above-described components may each be mixed using a mixer to obtain a mixed powder for powder metallurgy. The addition and mixing of each component may be performed once or in two or more times.

In the case of using the binder, for example, the mixture may be stirred while being heated to the melting point of the binder or higher during the mixing, and gradually cooled while being mixed. In this way, the surface of the iron-based powder is coated with the molten binder, and the alloying powder and other components are adhered to the iron-based powder via the binder.

The mixing means is not particularly limited and may use anything such as all kinds of known mixers. From the viewpoint of easy heating, it is preferable to use at least one selected from the group consisting of a high-speed bottom stirring mixer, an inclined rotating pan-type mixer, a rotating hoe-type mixer, and a conical planetary screw-type mixer.

EXAMPLES

Example 1

Mixed powders for powder metallurgy were prepared by the following procedure. The properties of the obtained mixed powder for powder metallurgy, and the properties of a green compact prepared with the mixed powder for powder metallurgy were evaluated.

First, a (b) lubricant and an (c) alloying powder were added to an (a) iron-based powder, and these components were heated and mixed at a temperature equal to or higher than the melting point of the lubricant and then cooled to the melting point or lower. An iron powder (pure iron powder) (JIP301A manufactured by JFE Steel Corporation) prepared with an atomizing method was used as the (a) iron-based powder. The median size D50 of the iron powder was 80 μm.

Components used as the (b) lubricant and the (c) alloying powder and the mix proportion of each component are listed in Table 1. Regarding the lubricant, the number of carbon atoms of R (alkyl group or alkenyl group) contained in the fatty acid and the melting point of the lubricant are also listed in Table 1.

As used herein, the symbols of the lubricants listed in Table 1 and Tables 2 to 4, which will be described later, refer to the following lubricants, respectively.

(b1) Sucrose lauric acid ester (manufactured by MITSUBISHI-CHEMICAL FOODS CORPORATION, RYOTO® (RYOTO is a registered trademark in Japan, other countries, or both) Sugar Ester L-595)

(b2) Sucrose myristic acid ester (manufactured by MITSUBISHI-CHEMICAL FOODS CORPORATION, RYOTO® Sugar Ester M-1695)

(b3) Sucrose palmitic acid ester (manufactured by MITSUBISHI-CHEMICAL FOODS CORPORATION, RYOTO® Sugar Ester P-170)

(b4) Sucrose stearic acid ester (manufactured by MITSUBISHI-CHEMICAL FOODS CORPORATION, RYOTO® Sugar Ester S-170)

(b5) Sucrose stearic acid ester (manufactured by MITSUBISHI-CHEMICAL FOODS CORPORATION, RYOTO® Sugar Ester S-370)

(b6) Sucrose stearic acid ester (manufactured by MITSUBISHI-CHEMICAL FOODS CORPORATION, RYOTO® Sugar Ester S-1170)

(b7) Sucrose oleic acid ester (manufactured by MITSUBISHI-CHEMICAL FOODS CORPORATION, RYOTO® Sugar Ester O-1570)

(b8) Sucrose behenic acid ester (manufactured by MITSUBISHI-CHEMICAL FOODS CORPORATION, RYOTO® Sugar Ester B-370)

(b9) N, N'-ethylenebisacrylamide (manufactured by DAINICHI CHEMICAL INDUSTRY CO., LTD.)

(b10) Zinc stearate (manufactured by ADEKA CHEMICAL SUPPLY CORPORATION, ZNS-730)

Among the above lubricants, b4 to b6 are all sucrose stearic acid esters, yet the degree of esterification is different. Further, b4 to b6 and b7 all have 17 carbon atoms in R. However, b4 to b6 are esters of stearic acid which is a saturated fatty acid, and b7, on the other hand, is an ester of oleic acid which is a monounsaturated fatty acid.

The median size D50 of the copper powder used as the (c) alloying powder was 4.2 μm. In the present example, the lubricant also serves as a binder. That is, the alloying powder adheres to the surface of the iron-based powder via the lubricant which also serves as a binder.

Next, the apparent density and the powder fluidity of each of the obtained mixed powder for powder metallurgy were evaluated by the following procedure. The measurement results are also listed in Table 1.

(Apparent Density)

The apparent density was evaluated using a funnel having a diameter of 2.5 mm according to the method specified in JIS Z 2504.

(Limit Outflow Diameter)

The powder fluidity was evaluated based on a limit outflow diameter. First, a container was prepared, where the container had a cylindrical shape with an inner diameter of 67 mm and a height of 33 mm and was provided with a discharge hole whose diameter could be changed at the bottom. With the discharge hole closed, the container was filled with the mixed powder at an amount of slightly overflowing from the container. After keeping this state for 5 minutes, the powder above the brim of the container was leveled off with a spatula along the brim of the container. Next, the discharge hole was gradually opened, and the minimum diameter at which the mixed powder could be discharged was measured. The minimum diameter was defined as the limit outflow diameter. The smaller the limit outflow diameter is, the better the fluidity is.

(Green Density and Ejection Force)

Further, a green compact was prepared using the mixed powder for powder metallurgy, and the density (green density) and the ejection force of the obtained green compact were evaluated. In the evaluation, a tablet-shaped green compact having a diameter of 11.3 mm×10 mm was prepared by subjecting the mixed powder to compaction at a pressure of 686 MPa in accordance with JIS Z 2508 and JPMA P 10. The green density was calculated from the size and the weight of the obtained green compact. The ejection force was determined from the ejection load when the green compact was ejected out of the die. The measurement results are also listed in Table 1.

As can be seen from the results listed in Table 1, the mixed powder for powder metallurgy satisfying the conditions of the present disclosure had a higher green density than Comparative Examples and was excellent in compressibility. In addition, the mixed powder for powder metallurgy satisfying the conditions of the present disclosure had a lower ejection force than Comparative Examples and was excellent in ejection properties.

TABLE 1

| | Mixed powder for powder metallurgy | | | | | | | | | | | |
|---|---|---|---|---|---|---|---|---|---|---|---|---|
| | Composition | | | | | | | | | | | |
| | (a) Iron-based powder | | | | | (c) Alloying powder | | | | | | |
| | Iron powder | (b) Lubricant *1 | | | | Copper powder | Graphite powder | Evaluation results | | Green compact Evaluation results | | |
| No. | Content (part by mass) | Type | Number of carbon atoms of R | Melting point (° C.) | Content (part by mass) *2 | Content (part by mass) *2 | Content (part by mass) *2 | Apparent density (g/cm$^3$) | Limit outflow diameter (mm) | Green density (g/cm$^3$) | Ejection force (MPa) | Remarks |
| 1 | 100 | b1 | 11 | 45 | 0.8 | 2.0 | 0.8 | 3.16 | 35 | 7.15 | 14.0 | Example |
| 2 | 100 | b2 | 13 | 47 | 0.8 | 2.0 | 0.8 | 3.43 | 15 | 7.13 | 14.7 | Example |
| 3 | 100 | b3 | 15 | 56 | 0.8 | 2.0 | 0.8 | 3.40 | 17.5 | 7.13 | 14.7 | Example |
| 4 | 100 | b4 | 17 | 61 | 0.8 | 2.0 | 0.8 | 3.11 | 37.5 | 7.16 | 13.3 | Example |
| 5 | 100 | b5 | 17 | 58 | 0.8 | 2.0 | 0.8 | 3.19 | 35 | 7.15 | 13.3 | Example |
| 6 | 100 | b6 | 17 | 55 | 0.8 | 2.0 | 0.8 | 3.42 | 15 | 7.14 | 14.2 | Example |
| 7 | 100 | b7 | 17 | 43 | 0.8 | 2.0 | 0.8 | 3.17 | 35 | 7.15 | 13.5 | Example |
| 8 | 100 | b8 | 21 | 63 | 0.8 | 2.0 | 0.8 | 3.11 | 35 | 7.15 | 14.4 | Example |
| 9 | 100 | b9 | — | 140-145 | 0.8 | 2.0 | 0.8 | 3.34 | 30 | 7.10 | 15.1 | Comparative Example |
| 10 | 100 | b10 | — | 125 | 0.8 | 2.0 | 0.8 | 3.57 | 15 | 7.15 | 18.4 | Comparative Example |

*1 In the present example, the lubricant also serves as a binder.

*2 It is an amount with respect to 100 parts by mass of the iron-based powder.

Example 2

In addition, mixed powders for powder metallurgy containing (f) carbon black were prepared, and they were evaluated in the same manner as in Example 1. The type and mix proportion of components used are listed in Table 2. The median size D50 of the carbon black used was 25 nm.

During the preparation of the mixed powder, first, a (b) lubricant and an (c) alloying powder were added to an (a) iron-based powder, and these components were heated and mixed at a temperature equal to or higher than the melting point of the lubricant and then cooled to the melting point or lower. Thereafter, (f) carbon black was added to the cooled powder and mixed to obtain a mixed powder for powder metallurgy. Other conditions were the same as those in Example 1. The evaluation results are listed in Table 2.

As can be seen from the results listed in Table 2, the compressibility was deteriorated and the green density was lowered in the mixed powder of Comparative Example due to the addition of carbon black, yet the mixed powder for powder metallurgy satisfying the conditions of the present disclosure still had good compressibility. In addition, the ejection properties were deteriorated and the ejection force was increased in the mixed powder of Comparative Example due to the addition of carbon black, yet the mixed powder for powder metallurgy satisfying the conditions of the present disclosure still had good ejection properties. Thus, the mixed powder for powder metallurgy of the present disclosure can achieve excellent fluidity, ejection properties, and compressibility in the case of using carbon black.

Example 3

In Examples 1 and 2, the mixed powders for powder metallurgy were prepared by heating and mixing the components at a temperature equal to or higher than the melting point of the lubricant. Therefore, in Examples 1 and 2, the lubricant also serves as a binder. However, the present disclosure is also effective in the case of using no binder, that is, in the case where the lubricant is simply mixed without being heated.

To evaluate the properties of the mixed powder for powder metallurgy in the case of using no binder, a (b) lubricant, an (c) alloying powder, and (f) carbon black were added to an (a) iron-based powder, and the components were mixed for 15 minutes at room temperature using a V-shaped blender to obtain a mixed powder for powder metallurgy. The type and mix proportion of the components used, and the evaluation results are listed in Table 3.

As can be seen from the results listed in Table 3, the mixed powder for powder metallurgy satisfying the conditions of the present disclosure has a higher green density than Comparative Examples and was excellent in compressibility. In addition, the mixed powder for powder metallurgy satisfying the conditions of the present disclosure had a lower ejection force than Comparative Example and was excellent in ejection properties. Further, although the ejection properties and the compressibility of the mixed powders of Comparative Examples were deteriorated due to the addition of carbon black, the mixed powder for powder metallurgy satisfying the conditions of the present disclosure still had good ejection properties and compressibility.

TABLE 2

| | Mixed powder for powder metallurgy | | | | | | | | | | | | |
|---|---|---|---|---|---|---|---|---|---|---|---|---|---|
| | Composition | | | | | | | | | | | | |
| | (a) Iron-based powder | (b) Lubricant *1 | | | | (c) Alloying powder | | (f) | Evaluation results | | Green compact | | |
| | Iron powder | | Number | | | Copper powder | Graphite powder | Carbon black | | Limit | Evaluation results | | |
| No. | Content (part by mass) | Type | of carbon atoms of R | Melting point (° C.) | Content (part by mass) *2 | Content (part by mass) *2 | Content (part by mass) *2 | Content (part by mass) *2 | Apparent density (g/cm$^3$) | outflow diameter (mm) | Green density (g/cm$^3$) | Ejection force (MPa) | Remarks |
| 20 | 100 | b1 | 11 | 45 | 0.7 | 2.0 | 0.8 | 0.1 | 3.33 | 5 | 7.14 | 17.0 | Example |
| 21 | 100 | b2 | 13 | 47 | 0.7 | 2.0 | 0.8 | 0.1 | 3.44 | 2.5 | 7.12 | 17.4 | Example |
| 22 | 100 | b3 | 15 | 56 | 0.7 | 2.0 | 0.8 | 0.1 | 3.43 | 2.5 | 7.12 | 17.4 | Example |
| 23 | 100 | b4 | 17 | 61 | 0.7 | 2.0 | 0.8 | 0.1 | 3.29 | 5 | 7.16 | 16.4 | Example |
| 24 | 100 | b5 | 17 | 58 | 0.7 | 2.0 | 0.8 | 0.1 | 3.35 | 5 | 7.15 | 16.6 | Example |
| 25 | 100 | b6 | 17 | 55 | 0.7 | 2.0 | 0.8 | 0.1 | 3.45 | 2.5 | 7.12 | 17.5 | Example |
| 26 | 100 | b7 | 17 | 43 | 0.7 | 2.0 | 0.8 | 0.1 | 3.34 | 5 | 7.15 | 16.6 | Example |
| 27 | 100 | b8 | 21 | 63 | 0.7 | 2.0 | 0.8 | 0.1 | 3.29 | 5 | 7.14 | 17.1 | Example |
| 28 | 100 | b9 | — | 140-145 | 0.7 | 2.0 | 0.8 | 0.1 | 3.39 | 2.5 | 7.07 | 18.1 | Comparative Example |

*1 In the present example, the lubricant also serves as a binder.

*2 It is an amount with respect to 100 parts by mass of the iron-based powder.

TABLE 3

| | Mixed powder for powder metallurgy | | | | | | | | | | | | |
|---|---|---|---|---|---|---|---|---|---|---|---|---|---|
| | Composition | | | | | | | | | | | | |
| | (a) Iron-based powder | | | | | (c) Alloying powder | | (f) | | | | | |
| | Iron powder | (b) Lubricant | | | | Copper powder | Graphite powder | Carbon black | Evaluation results | | Green compact Evaluation results | | |
| No. | Content (part by mass) | Type | Number of carbon atoms of R | Melting point (° C.) | Content (part by mass) * | Content (part by mass) * | Content (part by mass) * | Content (part by mass) * | Apparent density (g/cm$^3$) | Limit outflow diameter (mm) | Green density (g/cm$^3$) | Ejection force (MPa) | Remarks |
| 30 | 100 | b1 | 11 | 45 | 0.8 | 2.0 | 0.8 | — | 2.96 | 45 | 7.13 | 12.0 | Example |
| 31 | 100 | b2 | 13 | 47 | 0.8 | 2.0 | 0.8 | — | 3.23 | 25 | 7.11 | 12.7 | Example |
| 32 | 100 | b3 | 15 | 56 | 0.8 | 2.0 | 0.8 | — | 3.2 | 27.5 | 7.11 | 12.7 | Example |
| 33 | 100 | b4 | 17 | 61 | 0.8 | 2.0 | 0.8 | — | 2.91 | 47.5 | 7.14 | 11.3 | Example |
| 34 | 100 | b5 | 17 | 58 | 0.8 | 2.0 | 0.8 | — | 2.99 | 45 | 7.13 | 11.3 | Example |
| 35 | 100 | b6 | 17 | 55 | 0.8 | 2.0 | 0.8 | — | 3.22 | 25 | 7.12 | 12.2 | Example |
| 36 | 100 | b7 | 17 | 43 | 0.8 | 2.0 | 0.8 | — | 2.97 | 45 | 7.13 | 11.5 | Example |
| 37 | 100 | b8 | 21 | 63 | 0.8 | 2.0 | 0.8 | — | 2.91 | 45 | 7.13 | 12.4 | Example |
| 38 | 100 | b9 | — | 140-145 | 0.8 | 2.0 | 0.8 | — | 3.14 | 40 | 7.04 | 13.1 | Comparative Example |
| 39 | 100 | b1 | 11 | 45 | 0.7 | 2.0 | 0.8 | 0.1 | 3.16 | 5 | 7.08 | 14.0 | Example |
| 40 | 100 | b2 | 13 | 47 | 0.7 | 2.0 | 0.8 | 0.1 | 3.27 | 2.5 | 7.06 | 14.4 | Example |
| 41 | 100 | b3 | 15 | 56 | 0.7 | 2.0 | 0.8 | 0.1 | 3.26 | 2.5 | 7.06 | 14.4 | Example |
| 42 | 100 | b4 | 17 | 61 | 0.7 | 2.0 | 0.8 | 0.1 | 3.12 | 5 | 7.10 | 13.4 | Example |
| 43 | 100 | b5 | 17 | 58 | 0.7 | 2.0 | 0.8 | 0.1 | 3.18 | 5 | 7.09 | 13.6 | Example |
| 44 | 100 | b5 | 17 | 58 | 0.7 | 2.0 | 0.8 | 0.05 | 3.12 | 5 | 7.10 | 12.5 | Example |
| 45 | 100 | b5 | 17 | 58 | 0.7 | 2.0 | 0.8 | 0.25 | 3.27 | 2.5 | 7.06 | 14.5 | Example |
| 46 | 100 | b6 | 17 | 55 | 0.7 | 2.0 | 0.8 | 0.1 | 3.28 | 2.5 | 7.06 | 14.5 | Example |
| 47 | 100 | b7 | 17 | 43 | 0.7 | 2.0 | 0.8 | 0.1 | 3.17 | 5 | 7.09 | 13.6 | Example |
| 48 | 100 | b8 | 21 | 63 | 0.7 | 2.0 | 0.8 | 0.1 | 3.12 | 5 | 7.08 | 14.1 | Example |
| 49 | 100 | b9 | — | 140-145 | 0.7 | 2.0 | 0.8 | 0.1 | 3.22 | 2.5 | 7.01 | 15.1 | Comparative Example |

* It is an amount with respect to 100 parts by mass of the iron-based powder.

Example 4

Although copper powder and graphite powder were used in all of Examples 1, 2 and 3 described above, the present disclosure is also effective in the case of using no copper powder or graphite powder.

To evaluate the properties of the mixed powder for powder metallurgy in the case of using no copper powder or graphite powder, a mixed powder for powder metallurgy containing an (a) iron-based powder and a (b) lubricant, and a mixed powder for powder metallurgy containing an (a) iron-based powder, a (b) lubricant and (f) carbon black were prepared. The preparation method was the same as in Examples 1 and 2. The type and mix proportion of the components used, and the evaluation results are listed in Table 4.

As can be seen from the results listed in Table 4, the mixed powder for powder metallurgy satisfying the conditions of the present disclosure has a higher green density than Comparative Examples and was excellent in compressibility. In addition, the mixed powder for powder metallurgy satisfying the conditions of the present disclosure had a lower ejection force than Comparative Example and was excellent in ejection properties. The experimental results in the case of using an iron powder as the iron-based powder have been indicated in the above Examples, and the same applies to the case of using an alloyed steel powder as the iron-based powder, in which the mixed powder for powder metallurgy satisfying the conditions of the present disclosure had excellent compressibility and ejection properties.

TABLE 4

| | Mixed powder for powder metallurgy | | | | | | | | | | |
|---|---|---|---|---|---|---|---|---|---|---|---|
| | Composition | | | | | | | | | | |
| | (a) Iron-based powder | | | | | (f) Carbon black | Evaluation results | | Green compact Evaluation results | | |
| | Iron powder | (b) Lubricant *1 | | | | | | Limit | | | |
| No. | Content (part by mass) | Type | Number of carbon atoms of R | Melting point (° C.) | Content (part by mass) *2 | Content (part by mass) *2 | Apparent density (g/cm$^3$) | outflow diameter (mm) | Green density (g/cm$^3$) | Ejection force (MPa) | Remarks |
| 50 | 100 | b5 | 17 | 58 | 0.8 | — | 3.20 | 35 | 7.12 | 13.5 | Example |
| 51 | 100 | b8 | 21 | 63 | 0.8 | — | 3.12 | 35 | 7.12 | 14.6 | Example |

TABLE 4-continued

| | Mixed powder for powder metallurgy | | | | | | | | | | |
|---|---|---|---|---|---|---|---|---|---|---|---|
| | Composition | | | | | | | | | | |
| | (a) Iron-based powder | | | | | (f) Carbon | Evaluation results | | Green compact | | |
| | Iron powder | (b) Lubricant *1 | | | | black | | Limit | Evaluation results | | |
| No. | Content (part by mass) | Type | Number of carbon atoms of R | Melting point (° C.) | Content (part by mass) *2 | Content (part by mass) *2 | Apparent density (g/cm$^3$) | outflow diameter (mm) | Green density (g/cm$^3$) | Ejection force (MPa) | Remarks |
| 52 | 100 | b9 | — | 140-145 | 0.8 | — | 3.35 | 30 | 7.08 | 15.3 | Comparative Example |
| 53 | 100 | b5 | 17 | 58 | 0.7 | 0.1 | 3.36 | 5 | 7.13 | 16.9 | Example |
| 54 | 100 | b8 | 21 | 63 | 0.7 | 0.1 | 3.30 | 5 | 7.12 | 17.3 | Example |
| 55 | 100 | b9 | — | 140-145 | 0.7 | 0.1 | 3.40 | 2.5 | 7.05 | 18.3 | Comparative Example |

*1 In the present example, the lubricant also serves as a binder.
*2 It is an amount with respect to 100 parts by mass of the iron-based powder.

The invention claimed is:

1. A mixed powder for powder metallurgy comprising an (a) iron-based powder and a (b) lubricant, wherein the (b) lubricant is an ester of disaccharide and fatty acid represented by R—COOH, and the R is an alkyl group having 11 or more carbon atoms or an alkenyl group having 11 or more carbon atoms.

2. The mixed powder for powder metallurgy according to claim 1, wherein the R is an alkyl group having 11 to 21 carbon atoms or an alkenyl group having 11 to 21 carbon atoms.

3. The mixed powder for powder metallurgy according to claim 1, wherein the lubricant has a melting point of 40° C. or higher.

4. The mixed powder for powder metallurgy according to claim 2, wherein the lubricant has a melting point of 40° C. or higher.

5. The mixed powder for powder metallurgy according to claim 1, further comprising one or both of an (c) alloying powder and a (d) machinability improver.

6. The mixed powder for powder metallurgy according to claim 2, further comprising one or both of an (c) alloying powder and a (d) machinability improver.

7. The mixed powder for powder metallurgy according to claim 3, further comprising one or both of an (c) alloying powder and a (d) machinability improver.

8. The mixed powder for powder metallurgy according to claim 4, further comprising one or both of an (c) alloying powder and a (d) machinability improver.

9. The mixed powder for powder metallurgy according to claim 5, wherein one or both of the (c) alloying powder and the (d) machinability improver are adhered to a surface of the (a) iron-based powder via a (e) binder.

10. The mixed powder for powder metallurgy according to claim 6, wherein one or both of the (c) alloying powder and the (d) machinability improver are adhered to a surface of the (a) iron-based powder via a (e) binder.

11. The mixed powder for powder metallurgy according to claim 7, wherein one or both of the (c) alloying powder and the (d) machinability improver are adhered to a surface of the (a) iron-based powder via a (e) binder.

12. The mixed powder for powder metallurgy according to claim 8, wherein one or both of the (c) alloying powder and the (d) machinability improver are adhered to a surface of the (a) iron-based powder via a (e) binder.

13. The mixed powder for powder metallurgy according to claim 9, wherein the binder (e) is the ester of disaccharide and fatty acid.

14. The mixed powder for powder metallurgy according to claim 10, wherein the binder (e) is the ester of disaccharide and fatty acid.

15. The mixed powder for powder metallurgy according to claim 11, wherein the binder (e) is the ester of disaccharide and fatty acid.

16. The mixed powder for powder metallurgy according to claim 12, wherein the binder (e) is the ester of disaccharide and fatty acid.

17. The mixed powder for powder metallurgy according to claim 9, further comprising (f) carbon black in an amount of 0.01 parts by mass to 0.3 parts by mass with respect to 100 parts by mass of the (a) iron-based powder.

18. The mixed powder for powder metallurgy according to claim 13, further comprising (f) carbon black in an amount of 0.01 parts by mass to 0.3 parts by mass with respect to 100 parts by mass of the (a) iron-based powder.

19. The mixed powder for powder metallurgy according to claim 1, wherein the disaccharide is sucrose.

* * * * *